US005636933A

United States Patent [19]

Vizsolyi

[11] Patent Number: 5,636,933

[45] Date of Patent: Jun. 10, 1997

[54] TRAVEL TOOTHBRUSH WITH INCREMENTAL TOOTHPASTE DISPENSER

[76] Inventor: Steve Vizsolyi, 101 Park Ave., Morrisville, Pa. 19067

[21] Appl. No.: 549,870

[22] Filed: Oct. 30, 1995

[51] Int. Cl.[6] ..... A46B 17/04; A45D 44/18

[52] U.S. Cl. ..... 401/269; 401/171; 401/192; 401/286; 132/308; 222/41; 222/43

[58] Field of Search ..... 401/155, 170, 401/171, 176, 181, 186, 268, 278, 269, 286, 192; 222/41, 43, 209, 386; 132/311, 308

[56] References Cited

U.S. PATENT DOCUMENTS

| | | | |
|---|---|---|---|
| 1,727,743 | 9/1929 | Pilmore-Bedford et al. | 222/43 |
| 1,768,301 | 3/1930 | Weber | 132/308 X |
| 2,053,145 | 9/1936 | Hamel | 401/269 X |
| 2,096,461 | 10/1937 | Mane et al. | 222/43 |
| 2,299,564 | 10/1942 | Castillo | 401/170 |
| 2,487,825 | 11/1949 | Olvis | 222/43 X |
| 3,728,035 | 4/1973 | Reitknecht | 401/296 X |
| 4,149,552 | 4/1979 | Stewmon | 401/286 X |
| 5,100,252 | 3/1992 | Podolsky | 401/278 X |
| 5,421,663 | 6/1995 | Bravo | 401/176 X |

FOREIGN PATENT DOCUMENTS

| | | | |
|---|---|---|---|
| 0051251 | 4/1977 | Japan | 401/269 |

*Primary Examiner*—Robert A. Hafer
*Assistant Examiner*—D. Neal Muir

[57] ABSTRACT

The travel toothbrush with incremental toothpaste dispenser comprising: a main housing with open inboard and outboard ends, the main housing having an inner surface with diametrically spaced detents, a toothbrush having a brush head and a reservoir affixed to the open inboard end of the main housing, the brush head having a base including a plurality of bristles and a central channel extending therein, the channel being in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

4 Claims, 3 Drawing Sheets

TRAVEL TOOTHBRUSH WITH INCREMENTAL TOOTHPASTE DISPENSER

BACKGROUND OF THE INVENTION

1. Field of the Invention

The present invention relates to a travel toothbrush with incremental toothpaste dispenser and more particularly pertains to dispensing a predetermined quantity of toothpaste by depressing the plunger of the apparatus.

2. Description of the Prior Art

The use of paste dispensing toothbrushes is known in the prior art. More specifically, paste dispensing toothbrushes heretofore devised and utilized for the purpose of applying toothpaste to toothbrushes are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,346,324 to Kuo a dentrifice dispensing toothbrush with replaceable cartridge.

U.S. Pat. No. 5,158,383 to Glover discloses a paste dispensing brush.

U.S. Pat. No. Des. 329,948 to Hanner discloses a combined toothbrush and toothpaste dispenser.

U.S. Pat. No. 3,864,047 to Sherrod discloses a toothbrush with resilient pump for supplying paste to brush.

U.S. Pat. No. 5,145,095 to Loudon discloses a dispenser for deformable tube packaged semi-solid products.

Lastly, U.S. Pat. No. 5,230,444 to Dunbar discloses a toothpaste dispenser apparatus.

In this respect, the travel toothbrush with incremental toothpaste dispenser according to the present invention substantially departs from the conventional concepts and designs of the prior art, and in doing so provides an apparatus primarily developed for the purpose of dispensing a predetermined quantity of toothpaste by depressing the plunger of the apparatus.

Therefore, it can be appreciated that there exists a continuing need for a new and improved travel toothbrush with incremental toothpaste dispenser which can be used for dispensing a predetermined quantity of toothpaste by depressing the plunger of the apparatus. In this regard, the present invention substantially fulfills this need.

SUMMARY OF THE INVENTION

In view of the foregoing disadvantages inherent in the known types of paste dispensing toothbrushes now present in the prior art, the present invention provides an improved travel toothbrush with incremental toothpaste dispenser. As such, the general purpose of the present invention, which will be described subsequently in greater detail, is to provide a new and improved travel toothbrush with incremental toothpaste dispenser and method which has all the advantages of the prior art and none of the disadvantages.

To attain this, the present invention essentially comprises a new and improved travel toothbrush with incremental toothpaste dispenser comprising, in combination: a main housing formed in an elongated hollow generally cylindrical configuration with an open inboard end, an open outboard end and an axis, the outboard end including two slots with a resilient tab positioned therebetween, the tab including a detent positioned thereupon, the main housing having an upper surface including a transparent window formed therein, the window having an elongated central portion positioned parallel with the axis of the main housing, the window including six transversely positioned incremental portions positioned equidistantly along the central portion of thereof, the main housing having an inner surface including diametrically opposing detents positioned above and below each incremental portion of the window; a toothbrush having a brush head and a reservoir, the reservoir formed in a hollow generally cylindrical configuration with a first open end affixed to the open inboard end of the main housing, the first end of the reservoir including a plurality of external screw threads positioned therearound, the reservoir having a second open end with a smaller diameter than the first open end, the brush head having a base formed in a generally rectangular configuration with an upper surface including a plurality of bristles extending therefrom, the brush head having a first end formed contiguously with the second end of the reservoir, the base of the brush head including a central channel extending therein and in communication with the reservoir, a plurality of bores being positioned in the upper surface of the base and in communication with the central channel; a plunger formed in a generally cylindrical configuration with an inboard end and an outboard end, the outboard end including a planar circular knob and the inboard end including a planar circular shaped projection extending therefrom, a rubber piston being rotatably coupled around the planar circular projection, the plunger having an outer surface including six diametrically opposing pairs of indents, an indent also being positioned on the outer surface of the plunger adjacent to the outboard end thereof, in an operative orientation the main housing being filled with toothpaste with the plunger being positioned within the main housing through the open outboard end, the detents of the housing adapted to be positioned within the indents of the plunger to lock the plunger in a stable orientation, in operation the user pushing the plunger further within the main housing thereby forcing toothpaste into the reservoir and channel and onto the bristles, the distance between each pair of increments representing one day's supply of toothpaste; and a cap formed in a generally cylindrical configuration with a plurality of air holes extending therethrough, the cap having an open end including a plurality of internal screw threads, the cap adapted to be positioned over the brush head and threadedly coupled to the external screw threads of the reservoir when storage of the brush is desired, the cap further including a pocket clip affixed thereto to permit coupling to a user's pocket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved travel toothbrush with incremental toothpaste dispenser which has all of the advantages of the prior art paste dispensing toothbrushes and none of the disadvantages.

It is another object of the present invention to provide a new and improved travel toothbrush with incremental toothpaste dispenser which may be easily and efficiently manufactured and marketed.

It is further object of the present invention to provide a new and improved travel toothbrush with incremental toothpaste dispenser which is of durable and reliable constructions.

An even further object of the present invention is to provide a new and improved travel toothbrush with incremental toothpaste dispenser which is susceptible of a low cost of manufacture with regard to both materials and labor, and which accordingly is then susceptible of low prices of sale to the consuming public, thereby making such travel toothbrush with incremental toothpaste dispenser economically available to the buying public.

Still yet another object of the present invention is to provide a new and improved travel toothbrush with incremental toothpaste dispenser which provides in the apparatuses and methods of the prior art some of the advantages thereof, while simultaneously overcoming some of the disadvantages normally associated therewith.

Still another object of the present invention is to dispense a predetermined quantity of toothpaste by depressing the plunger of the apparatus.

Lastly, it is an object of the present invention to provide a new and improved travel toothbrush with incremental toothpaste dispenser comprising: a main housing formed in an elongated hollow configuration with open inboard and outboard ends, the main housing having an inner surface with diametrically spaced detents positioned therealong; a toothbrush having a brush head and a reservoir, the reservoir formed in a hollow configuration and affixed to the open inboard end of the main housing, the brush head having a base formed contiguously with the reservoir and including a plurality of bristles extending therefrom, the base including a central channel extending therein and in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
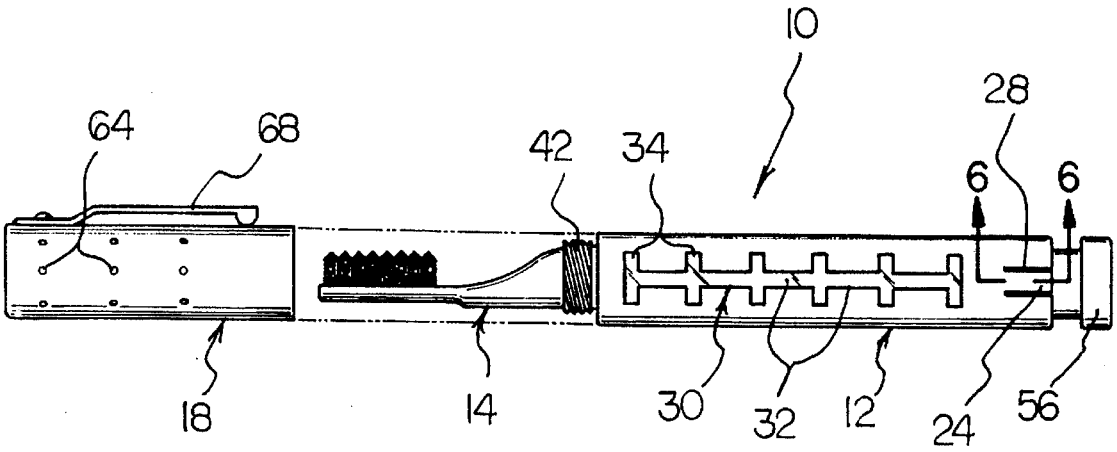
FIG. 1 is a perspective view of the preferred embodiment of the travel toothbrush with incremental toothpaste dispenser constructed in accordance with the principles of the present invention.

With reference now to the drawings, and in particular to FIG. 1 thereof, the preferred embodiment of the new and improved travel toothbrush with incremental toothpaste dispenser embodying the principles and concepts of the present invention and generally designated by the reference numeral 10 will be described.

The present invention, the travel toothbrush with incremental toothpaste dispenser 10 is comprised of a plurality of components. Such components in their broadest context include a main housing 12, a toothbrush 14, a plunger 16 and a cap 18. Such components are individually configured and correlated with respect to each other so as to attain the desired objective.

Figure 2:
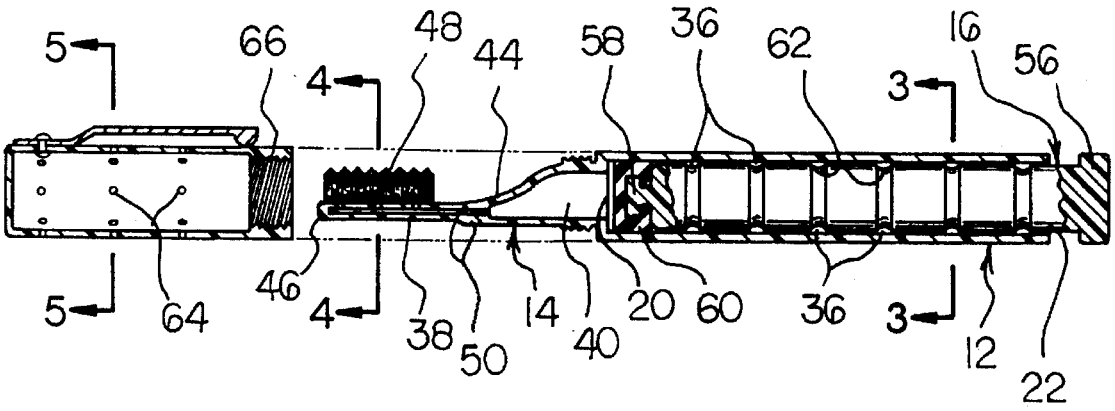
FIG. 2 is a longitudinal cross sectional view of the apparatus shown in FIG. 1.

More specifically, the main housing 12 is formed in an elongated hollow generally cylindrical configuration with an open inboard end 20, an open outboard end 22 and an axis. In the preferred embodiment the main housing is fabricated of plastic. The main housing and remaining components of the apparatus are formed in a plurality of different colors to suit the aesthetic tastes of the user. The main housing is three and one-quarter inches in length. The outboard end includes two slots 28 with a resilient tab 24 positioned therebetween. The tab has a detent 26 positioned upon it. The resilient tab provides a flexible clearance area to enable a user to insert and retract the plunger of the apparatus during use. Without the flexibility provided by the tab, maneuvering the plunger would be an arduous task. Note FIGS. 1 and 2.

Figure 3:
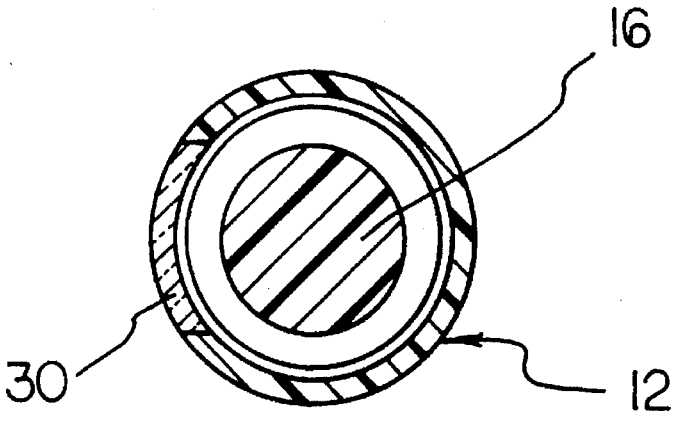
FIG. 3 is a cross sectional view taken along section line 3—3 of FIG. 2 illustrating the configuration of the main housing of the apparatus.

The main housing has an upper surface including a transparent window 30 formed in it. The window 30 has an elongated central portion 32 positioned parallel with the axis of the main housing. The window includes six transversely positioned incremental portions 34 positioned equidistantly along the central portion of it. The main housing has an inner surface which includes diametrically opposing detents 36 positioned above and below each incremental portion of the window. The plunger has corresponding indents which couple with the detents as the plunger is moved within the main housing. The window permits viewing of toothpaste and the plunger positioned within the main housing. The window is particularly useful when determining the amount of toothpaste remaining within the main housing. This can be easily determined by observing the positioning of the inboard end of the plunger relative to the transverse incremental portions of the window. The distance between each incremental portion represents one day's supply of toothpaste. In alternative embodiments of the apparatus numerals are positioned adjacent to the incremental portions to enable users to easily determine how much toothpaste is left in the housing at any point in time. Note FIGS. 1 and 3.

Figure 4:
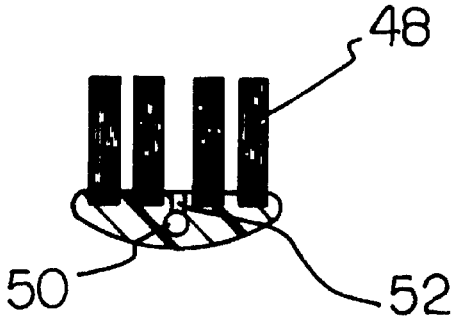
FIG. 4 is a cross sectional view taken along section line 4—4 of FIG. 2 and illustrating the configuration of the brush head of the apparatus.

A toothbrush 14 has a brush head 38 and a reservoir 40. The reservoir is formed in a hollow generally cylindrical configuration with a first open end affixed to the open inboard end of the main housing. As the plunger of the apparatus is pushed further within the main housing toothpaste is forced out the open inboard end 20 of the main housing and into the reservoir. The first open end of the reservoir includes a plurality of external screw threads 42 positioned around it. The reservoir has a second open end 44 with a smaller diameter than the first open end. The configuration of the reservoir ensures the smooth passage of toothpaste through the apparatus. Note FIGS. 1, 2 and 4.

The brush head has a base 46 formed in a generally rectangular configuration with an upper surface including a plurality of bristles 48 extending from it. The brush head has a first end formed contiguously with the second end of the reservoir. The base of the brush head includes a central channel 50 extending in it and in communication with the reservoir. A plurality of bores 52 are positioned in the upper surface of the base and in communication with the central channel. During use, toothpaste is forced from the main housing into the reservoir. It then passes through the central channel, out the bores and onto the bristles of the brush head. The bores are evenly distributed across the upper surface of the base so that toothpaste is provided to the bristles in an evenly distributed manner. Note FIGS. 1 and 2.

Figure 6:
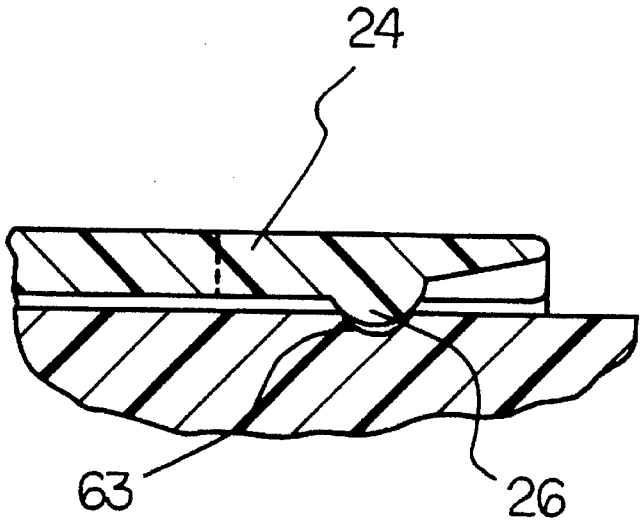
FIG. 6 is a cross sectional view taken along section line 6—6 of FIG. 1 illustrating the configuration of the resilient tab of the apparatus.

A plunger 16 is fabricated of plastic and formed in a generally cylindrical configuration with an inboard end and an outboard end. The plunger is about two inches in length. The outboard end includes a planar circular knob 56 and the inboard end includes a planar circular shaped projection 58 extending from it. The configuration of the planar circular knob enables a user to easily depress it with his thumb. Additionally, the knob has a larger diameter than the remainder of the plunger thereby facilitating withdrawal from the main housing. Note FIG. 2, A rubber piston 60 is rotatably coupled around the planar circular projection. The rubber piston is rotatable within the housing. This allows the plunger to be more easily inserted and moved along within the main housing unit. The rubber piston is tightly positioned within the main housing thereby ensuring a smooth and even movement of toothpaste. The piston also helps prevent the accumulation of residue on the sidewalls of the main housing. The plunger has an outer surface which includes six diametrically opposing pairs of indents 62. The indents lock within the indents positioned adjacent to the incremental portions of the window. This allows a user to force precisely one day's supply of toothpaste into the reservoir by locking the inboardmost indents of the plunger within the detents of the next successive incremental portion of the window. An indent 63 also is positioned on the outer surface of the plunger adjacent to the outboard end. This feature further secures the plunger within the main housing. Note FIG. 6.

In an operative orientation the main housing is filled with toothpaste with the plunger is positioned within the main housing through the open outboard end. The plunger is then inserted into the main housing. This is referred to as the open orientation. In the open orientation the length of the plunger and main housing is approximately five and a half inches in length. In the closed orientation the plunger is completely contained within the main housing. In this orientation the total length is approximately three and one-quarter inches. The detents of the housing are adapted to be positioned within the indents of the plunger to lock the plunger in a stable orientation. In operation the user pushes the plunger further within the main housing thereby forcing toothpaste into the reservoir and channel and onto the bristles. The distance between each pair of increments represent one day's supply of toothpaste. Note FIGS. 1 and 2.

Figure 5:
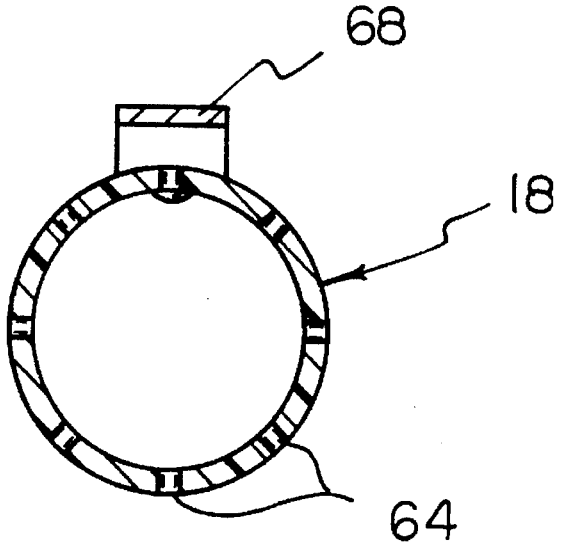
FIG. 5 is a cross sectional view taken along section line 5—5 of FIG. 2 and illustrating the configuration of the cap and pocket clip of the apparatus.

A cap 18 is formed in a generally cylindrical configuration with a plurality of air holes 64 extending through it. The air holes permit drying of the toothbrush when the apparatus has been stored. The cap has an open end which includes a plurality of internal screw threads 66. The cap is adapted to be positioned over the brush head and is threadedly coupled to the external screw threads of the reservoir when storage of the brush is desired. The cap further includes a pocket clip 68 affixed to it to permit coupling to a user's pocket. This convenient configuration permits a user to conveniently attach the apparatus to a pocket when traveling. The portion of the cap extending outside of the pocket resembles a pen. Note FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved travel toothbrush with incremental toothpaste dispenser comprising, in combination:

a main housing formed in an elongated hollow generally cylindrical configuration with an open inboard end, an open outboard end and an axis, the outboard end including two slots with a resilient tab positioned therebetween, the tab including a detent positioned thereupon, the main housing having an upper surface including a transparent window formed therein, the window having an elongated central portion positioned parallel with the axis of the main housing, the window including six transversely positioned incremental portions positioned equidistantly along the central portion of thereof, the main housing having an inner surface including diametrically opposing detents positioned above and below each incremental portion of the window;

a toothbrush having a brush head and a reservoir, the reservoir formed in a hollow generally cylindrical configuration with a first open end affixed to the open inboard end of the main housing, the first end of the reservoir including a plurality of external screw threads positioned therearound, the reservoir having a second open end with a smaller diameter than the first open end, the brush head having a base formed in a generally rectangular configuration with an upper surface including a plurality of bristles extending therefrom, the brush head having a first end formed contiguously with the second end of the reservoir, the base of the brush head including a central channel extending therein and in communication with the reservoir, a plurality of bores being positioned in the upper surface of the base and in communication with the central channel;

a plunger formed in a generally cylindrical configuration with an inboard end and an outboard end, the outboard end including a planar circular knob and the inboard end including a planar circular shaped projection extending therefrom, a rubber piston being rotatably coupled around the planar circular projection, the plunger having an outer surface including six diametrically opposing pairs of indents, an indent also being positioned on the outer surface of the plunger adjacent to the outboard end thereof, in an operative orientation the main housing being filled with toothpaste with the plunger being positioned within the main housing through the open outboard end, the detents of the housing adapted to be positioned within the indents of the plunger to lock the plunger in a stable orientation, in operation the user pushing the plunger further within the main housing thereby forcing toothpaste into the reservoir and channel and onto the bristles, the distance between each pair of increments representing one day's supply of toothpaste; and a cap formed in a generally cylindrical configuration with a plurality of air holes extending therethrough, the cap having an open end including a plurality of internal screw threads, the cap adapted to be positioned over the brush head and threadedly coupled to the external screw threads of the reservoir when storage of the brush is desired, the cap further including a pocket clip affixed thereto to permit coupling to a user's pocket.

2. The travel toothbrush with incremental toothpaste dispenser comprising:

a main housing formed in an elongated hollow configuration with open inboard and outboard ends, the main housing having an inner surface with diametrically opposed detents, the main housing having an upper surface including a transparent window formed therein, the window having an elongated central portion parallel to the axis of the main housing, the window including six transversely positioned incremental portions positioned equidistantly along the central portion thereof, the window permitting viewing of toothpaste movement within the main housing, the detents being positioned above and below each incremental portion of the window;

a toothbrush having a brush head and a reservoir, the reservoir formed in a hollow configuration and affixed to the open inboard end of the main housing, the brush head having a base formed contiguously with the reservoir and including a plurality of bristles extending therefrom, the base including a central channel extending therein and in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

3. The travel toothbrush with incremental toothpaste dispenser as set forth in claim 2 wherein the reservoir includes a plurality of external screw threads positioned therearound, the apparatus further including:

a cap having a plurality of air holes extending therethrough, the cap having an open end including a plurality of internal screw threads, the cap adapted to be positioned over the brush head and threadedly coupled to the external screw threads of the reservoir, the cap further including a pocket clip affixed thereto to permit coupling to a user's pocket.

4. The travel toothbrush with incremental toothpaste dispenser comprising:

a main housing formed in an elongated hollow configuration with open inboard and outboard ends, the main housing having an inner surface with diametrically spaced detents positioned therealong, the outboard end of the main housing including two slots and a resilient tab positioned therebetween, the tab defining a flexible clearance area for movement of the plunger within the main housing;

a toothbrush having a brush head and a reservoir, the reservoir formed in a hollow configuration and affixed to the open inboard end of the main housing, the brush head having a base formed contiguously with the reservoir and including a plurality of bristles extending therefrom, the base including a central channel extending therein and in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

* * * * *